United States Patent [19]

Nozaki

[11] 4,322,218

[45] Mar. 30, 1982

[54] $SO_2$ CAPTURE-COAL COMBUSTION

[75] Inventor: Kenzie Nozaki, Houston, Tex.

[73] Assignee: Shell Oil Company, Houston, Tex.

[21] Appl. No.: 154,637

[22] Filed: May 30, 1980

[51] Int. Cl.[3] ..... C10L 9/02

[52] U.S. Cl. ..... 44/1 SR; 44/4; 110/345; 431/2

[58] Field of Search ..... 44/1 SR, 4, 5; 110/345, 110/347; 431/2

[56] References Cited

U.S. PATENT DOCUMENTS

| | | | |
|---|---|---|---|
| 896,876 | 8/1908 | Williams | 44/4 |
| 2,014,686 | 9/1935 | Lubovitch et al. | 44/4 |
| 3,948,617 | 4/1976 | Withorn | 44/4 |
| 4,191,115 | 3/1980 | Yang et al. | 110/345 X |
| 4,226,601 | 10/1980 | Smith | 44/1 SR |
| 4,230,460 | 10/1980 | Maust, Jr. | 44/1 SR |

FOREIGN PATENT DOCUMENTS

| | | | |
|---|---|---|---|
| 469241 | 7/1937 | United Kingdom | 44/4 |
| 535649 | 4/1941 | United Kingdom | 44/4 |

*Primary Examiner*—Carl F. Dees

[57] ABSTRACT

Process for the combustion of particulate coal wherein the coal is combusted with an oxygen-containing gas in the presence of a particulate calcium-containing material, the process being also carried out in the presence of a tin (Sn)-containing material.

16 Claims, No Drawings

$SO_2$ CAPTURE-COAL COMBUSTION

BACKGROUND OF THE INVENTION

Combustion of various coals results in sulfur dioxide emissions in excess of governmental standards. Alkali impregnation of coal has been shown to be an inexpensive approach to reducing the $SO_2$ emissions from combustion of sulfur containing coal, and, under some conditions, may be economically competitive with stack gas scrubbing. CaO reacts with $SO_2$ from oxidation of coal sulfur compounds, ultimately forming $CaSO_4$ which is retained largely in the coal ash.

An alternate approach to the wet alkali coal impregnation technique is dry blending calcium containing materials, e.g., limestone, with coal before or during combustion. The commercial viability of this approach will depend in part on maximizing the $SO_2$ capture efficiency of the additive. While the type and origin of the calcium-containing additive is known to be an important factor in determining $SO_2$ capture efficiency, the effectiveness of the best calcium-containing additive has not been sufficient to reduce the $SO_2$ emissions to governmental requirements at practical loadings of limestone. Accordingly, a need has existed for improving the capture efficiency of calcium containing materials in coal combustion methods. The invention satisfies that need.

SUMMARY OF THE INVENTION

Accordingly, the invention comprises a process for the combustion of particulate coal wherein the coal is combusted with an oxygen-containing gas in the presence of a particulate calcium-containing material, the process being also carried out in the presence of a tin (Sn)-containing material. In its preferred form, the invention comprises a process of the type described in which $Cr_2O_3$ is combined with the tin-containing material. Most preferably, BaO is added to the preferred mixture. Preferably, the process is carried out by blending the coal, the calcium-containing material, and the additive prior to introduction into the burner. However, simultaneous introduction of the materials, preblending of the coal and the calcium-containing material followed by concomitant introduction of the additive into the burner, and staged addition of the materials are clearly within the contemplation of the invention.

Any suitable manner of blending the coal and capture materials may be employed. For example, the calcium-containing material, e.g., particulate limestone, may be dry-blended with the particulate coal, and the mix may then be wetted lightly with an additive containing solution.

The type of coal employed in the invention is much a matter of economics, but it is an advantage of the invention that low rank coals or lignites may be used. Accordingly, the term "coal", as used herein, includes such low rank materials as sub-bituminous coals and lignites. Similarly, the choice of calcium-containing materials is widely variable, the sole exception being, of course, $CaSO_4$. $CaCl_2$ may be used. As used herein, the term "reactive calcium-containing material" is understood to include any calcium-containing material which would provide calcium to react with $SO_2$ produced during combustion. In general, calcium-containing materials which are principally, or which decompose in the burner to provide CaO, are preferred. Limestones (principally $CaCO_3$), because of their low cost and wide availability, are a preferred source of a CaO-yielding material. However, such unusual sources as limes, oyster shells, etc., if reduced to appropriate size, may be employed. Whatever the case, the calcium-containing material will be supplied in the coal in an amount sufficient to capture or react with at least the bulk of the sulfur present in the coal. In general, the calcium-containing material or compound will be present in an amount of from about 1 percent to normally about 50 percent, preferably from about 5 percent to 20 percent (all by weight) based on the weight of the coal. Generally, the calcium-containing material will be employed in a particle size similar to that of the coal upon admission to the burner. Normally, the material will have a particle size of from 50 to 400 mesh, preferably 100 to 200 mesh.

As indicated, the efficiency of the calcium-containing material is enhanced by the addition of an effective amount of an additive containing tin. The type of tin-containing material does not appear critical. Tin compounds, such as the oxide, chloride, sulfide, etc., may be used. Tin-containing ores or tailings may be used. In general, the tin-containing material will be present in an amount effective to improve the efficiency of the capture of or reaction of the $SO_2$ generated during combustion. The tin will be present in an amount of at least 0.01 percent, and normally from about 0.01 percent to about 10.0 percent, preferably from about 0.05 percent or about 0.1 percent to about 10.0 percent, most preferably not more than about 5 percent (all by weight), based on the weight of the coal.

In the preferred embodiment, $Cr_2O_3$ will also be present. The combination will be employed, as indicated, in an effective amount, and the amount of the combination of tin-containing material and $Cr_2O_3$ employed will be similar to that of tin-containing material alone. If BaO is added, the amounts of tin-containing material and $Cr_2O_3$ remain the same. The ratio of tin-containing material to $Cr_2O_3$ (mol basis) will range from 0.2 to 1:1. If BaO is added, the ratio of tin-containing material to $Cr_2O_3$ to BaO will range from 0.2 to 1:1:0.05 to 0.3. If the additive is added as a particulate solid, the particle size will be similar to that of the coal.

In order to demonstrate the invention, the following experiments were carried out.

ILLUSTRATIVE EMBODIMENT I

To test the concept that tin-containing materials would increase the capture efficiency of calcium-containing materials by increasing the rate of reaction of $SO_2$ to $SO_3$, a simple flow apparatus utilizing a simulated flue gas and realistically high temperatures was employed. The results of the tests are shown in Table I.

TABLE I

CATALYSIS OF $SO_2$ TO $SO_3$

| | |
|---|---|
| Temperature: | 800° C. |
| Feed Flow Rate: | 250 cc/min |
| Feed Composition: | $SO_2$ 0.2% |
| | $O_2$ 2.4% |
| | $H_2O$ 2.4% |
| | $CO_2$ 9.7% |
| | $N_2$ 85.3% |
| Catalyst Diluent: | 1.0 g quartz chips (40/100 mesh) |
| Run Time: | 2.0 hours |
| Total Contact Time: | 0.03 sec |

| Catalyst | Weight, g | $SO_2$ Conversion, % | Weight, g | $SO_2$ Conversion, % | Weight, g | $SO_2$ Conversion, % |
|---|---|---|---|---|---|---|
| $Cr_2O_3$(60m%)/SnO(40m%) | | | 0.055 | 11.0 | | |
| $Cr_2O_3$(57m%)/SnO(38m%)/BaO(5m%) | 0.1 | 9.8 | 0.055[a] | 9.8,10.7[b] | | |
| $Cr_2O_3$(47.5m%)/SnO (47.5m%)/BaO(5m%) | | | 0.055 | 9.2 | | |
| SnO | | | 0.055 | 8.0 | | |

[a]Doubling flow rate to 500 cc/min resulted in 6.9% conversion.
[b]Repeat preparation of catalyst.

ILLUSTRATIVE EMBODIMENT II

To test the concept that additive material would increase the $SO_2$ capture efficiency of dolomitic limestones or limestones ($CaCO_3$), mixtures of the additives with limestone/coal blends were prepared and subjected to two small scale burn tests.

In these tests, the additive was added to a mixture of unbeneficiated Texas lignite and a locally available good quality limestone, Round Rock Limestone (Blum, Tex., total calcium=5.9% W). The results of the first test show that the addition of 3.4% W of SnO/$Cr_2O_3$/BaO resulted in a $SO_2$ capture efficiency of around 67%. A second, less stringent burn, in terms of sintering temperature, showed that the addition of 3.4 weight percent of the additive resulted in a 70 percent reduction of $SO_2$ emissions. The results are shown in Table II.

TABLE II

Unbeneficiated Texas Lignite (1.48% sulfur) 70 grams
Round Rock Limestone (Blum, Texas) 10 grams

| | | Test 1[a] | | Test 2[b] | |
|---|---|---|---|---|---|
| Additive | Wt, g (% w) | % $SO_2$ Emissions | lbs $SO_2$/$10^6$Btu | % $SO_2$ Emissions | lbs $SO_2$/$10^6$Btu |
| SnO/$Cr_2O_3$/BaO | 2.8(3.4%)[c] | 32.8–33.2 | 1.12–1.13 | 29.6 | 1.01 |

[a]Test 1: Microcombustor (1150° C., 1 second residence time, 3–11% $O_2$)
[b]Test 2: Hot tube (1050° C., 5 minute residence time)
[c]38m% SnO, 57m% $Cr_2O_3$, 5m% BaO

ILLUSTRATIVE EMBODIMENT III

Commercial application of CaO scavenging of $SO_2$ may be coupled with a prior benefication of the lignite to remove pyritic sulfur and to lower the ash content. The lowering of the intrinsic ash level will permit the addition of higher levels of limestone or CaO. To illustrate this approach, a 100 lb sample of beneficiated Texas lignite (1.37% w sulfur, 13.6% w ash) dry blended with Round Rock limestone (Blum, Tex., total calcium=6.5% w) was prepared. Microcombustor burn test results with this sample show that it has an $SO_2$ emission level close to 1.2 lbs/$10^6$ Btu. The addition of only 0.75% w of SnO/$Cr_2O_3$/BaO to this mixture resulted in $SO_2$ emission levels of 0.78–0.84 lbs $SO_2$/$10^6$ Btu. The results are shown in Table III.

TABLE III

Beneficiated Texas Lignite (1.3% sulfur) 42.4 grams
Round Rock Limestone (Blum, Texas) 7.6 grams

| | | Test1[a] | |
|---|---|---|---|
| Catalyst | Wt,g(%w) | % $SO_2$ Emissions | lbs $SO_2$/$10^6$Btu |
| None | — | 41.4–55.6 | 1.04–1.40 |
| $Cr_2O_3$/SnO/BaO[b] | 0.38 (0.75%) | 30.9–33.7 | 0.78–0.84 |

[a]Test 1: Microcombustor (1150° C., 1 second residence time, 3–11% $O_2$)
[b]38m% SnO, 57m% $Cr_2O_3$, 5m% BaO

What is claimed is:

1. In a process for the combustion of coal wherein a particulate coal is combusted with an oxygen-containing gas in the presence of a particulate calcium-containing material, the improvement comprising increasing the capture efficiency of the calcium-containing material by carrying out the combustion in the presence of an effective amount of a tin-containing material.

2. The process of claim 1 wherein the calcium-containing material is limestone.

3. The process of claim 2 wherein the coal is beneficiated coal.

4. The process of claim 3 wherein the tin-containing material is present in an amount of from about 0.05 percent by weight to about 10 percent by weight, based on the weight of the coal.

5. The process of claim 4 wherein the tin-containing material is SnO.

6. A process for increasing the capture efficiency of a particulate calcium-containing material during the combustion of coal comprising carrying out said combustion in the presence of said calcium-containing material and in the presence of an effective amount of a tin-containing material.

7. A process comprising burning particulate coal in the presence of a particulate calcium-containing material and an additive mixture comprising a tin-containing material and $Cr_2O_3$, the mol ratio of tin-containing material to $Cr_2O_3$ being from 0.2 to 1:1, and the additive mixture being present in an amount sufficient to improve the capture efficiency of the calcium-containing material.

8. The process of claim 7 wherein the calcium-containing material is limestone.

9. The process of claim 8 wherein the coal is beneficiated coal.

10. The process of claim 9 wherein the additive mixture is present in an amount of from about 0.1 percent by weight to about 5 percent by weight, based on the weight of the coal.

11. The process of claim 10 wherein the tin-containing material is SnO.

12. In a process for the combustion of coal wherein a particulate coal is combusted with an oxygen-containing gas in the presence of a particulate calcium-containing material, the improvement comprising carrying out the combustion in the presence of an additive mixture comprising SnO, $Cr_2O_3$, and BaO, the ratio of SnO:$Cr_2O_3$:BaO being from 0.2 to 1:1:0.05 to 0.3, and the additive mixture being present in an amount sufficient to improve the capture efficiency of the calcium-containing material.

13. A process comprising burning particulate coal in the presence of a particulate calcium-containing material and an additive mixture comprising SnO, $Cr_2O_3$, and BaO, the ratio of SnO:$Cr_2O_3$:BaO being from 0.2 to 1:1:0.5 to 0.3, and the additive mixture being present in an amount sufficient to improve the capture efficiency of the calcium-containing material.

14. The process of claim 13 wherein the calcium-containing material is limestone.

15. The method of claim 14 wherein the coal is beneficiated coal.

16. The method of claim 15 wherein the additive mixture is present in an amount of from about 0.1 percent by weight to about 5 percent by weight, based on the weight of the coal.

* * * * *